US006220136B1

(12) United States Patent
Benes et al.

(10) Patent No.: US 6,220,136 B1
(45) Date of Patent: Apr. 24, 2001

(54) MATERIAL CUTTING DEVICE AND METHOD

(75) Inventors: David Benes; Kelly Benes; David C. Mueller, all of Fremont, NE (US)

(73) Assignee: Waitt/Fremont Machine, L.L.C., Fremont, NE (US)

( * ) Notice: Subject to any disclaimer, the term of this patent is extended or adjusted under 35 U.S.C. 154(b) by 0 days.

(21) Appl. No.: 08/938,586

(22) Filed: Sep. 26, 1997

(51) Int. Cl.[7] ..... B26D 5/08

(52) U.S. Cl. ..... 83/566; 83/568; 83/569; 83/603; 83/285

(58) Field of Search ..... 83/566, 568, 569, 83/603, 284, 285, 531, 532

(56) References Cited

U.S. PATENT DOCUMENTS

| | | | | |
|---|---|---|---|---|
| 416 | * | 9/1837 | Leland | 83/284 |
| 8,144 | * | 6/1851 | Hill | 83/284 |
| 1,048,775 | * | 12/1912 | Wilkinson | 83/284 |
| 2,088,686 | * | 8/1937 | Blanchard, Jr. | 83/284 |
| 2,168,400 | * | 8/1939 | Evers | 83/284 |
| 2,168,401 | * | 8/1939 | Evers | 83/284 |
| 3,783,723 | * | 1/1974 | Van Orden | 83/284 X |
| 4,092,890 | * | 6/1978 | Bousquet | 83/284 |
| 4,643,062 | * | 2/1987 | Highfield et al. | 83/285 |
| 5,123,318 | * | 6/1992 | Su et al. | 83/284 X |
| 5,647,260 | * | 7/1997 | Nabity | 83/566 X |
| 5,778,748 | * | 7/1998 | Beijen | 83/529 |

* cited by examiner

*Primary Examiner*—M. Rachuba
(74) *Attorney, Agent, or Firm*—Zarley, McKee, Thomte , Vorhees & Sease; Dennis L. Thomte

(57) ABSTRACT

A material cutting device for cutting material using blade-cut dies includes a base plate adapted to support a blade-cut die thereon and a carriage movably mounted on the base plate. A press roller is rotatably mounted on the carriage, the press roller having a center longitudinal axis and being positioned above the base plate generally parallel therewith. A track device such as a rack is mounted on the base plate, and a track follower devicesuch as a rack-engaging gear is mounted on the carriage which is operative to engage said track device thereby guiding movement of the carriage on the base plate. A drive device is mounted on one of the base plate and the carriage, the drive device operative to move the carriage along the track device. A die cover is operative to cover a blade-cut die supported on said the plate. The press roller, the carriage and the drive device cooperate such that the drive device propels the carriage along the track device, the press roller engaging the die cover above a blade-cut die thereby forcing the die cover into contact with a blade-cut die supported on the base plate whereby material to be cut sandwiched between the die cover and a blade-cut die is cut in a shape designated by the blade-cut die.

9 Claims, 6 Drawing Sheets

MATERIAL CUTTING DEVICE AND METHOD

BACKGROUND OF THE INVENTION

1. Technical Field

The present invention relates to material cutting apparati and, more particularly, to a material cutting device for cutting materials such as paper, fabric, sponge and rubber using blade-cut dies which includes a base plate on which is movably mounted a carriage having a press roller, the carriage moving on the base plate such that the press roller engages a die cover plate placed over the paper placed on a blade-cut die on the base plate, thereby pressing the cover onto the blade-cut die and cutting a desired design out of the material.

2. Description of the Prior Art

There is much demand for machines which are capable of cutting shapes and designs, such as letters, numbers, or other such designs, out of various materials such as construction-type papers, fabrics, sponges, rubber and other materials. This demand arises generally from two major markets, the educational market, such as schools and pre-schools, and the craft and hobby market. The uses for such devices in the educational market are obvious, and include the cutting out of large numbers and letters from construction paper for use in classroom decorations to facilitate the teaching of those letters and numbers. The craft market also has similar needs, but expands the uses of a material cutting machine to other types of designs which are used in the making of craft arts and the like.

Various machines are presently used in the market for the cutting of such design and shapes, including units manufactured by Accucut and Ellison. These devices generally fulfill the intended purpose of cutting paper with a blade-cut die, but they each include inherent deficiencies. For example, the Ellison device requires the user to press the paper onto the blade-cut die by means of a long lever which can require substantial force to move the press device downwards. This can present a danger in that the lever, when released, may spring back upward due to the force that is being exerted by the die and paper, which may result in the lever impacting a person or object causing damage thereto. The Accucut device, on the other hand, uses a stationary press roller which, when rotated, causes a blade-cut die movably supported on a tray to travel thereunder. As the die passes under the roller, the paper is pressed down onto the blade-cut die thus cutting the design on the paper. In use, the Accucut device often causes slippage of the blade-cut die under the press roller resulting in corruption of the design being cut out of the material. This renders the cut-out shape unusable resulting in waste of that sheet. Moreover, both the Ellison and Accucut machines are limited in the number of sheets of material which may be cut at the same time, thus causing a user of the machines to have to use the machine several times to cut the amounts of paper that would be needed in a classroom setting or the like. There is therefore a need for a material cutting device which addresses and solves at least some of the problems presented in using the machines presently available in the market.

Briefly, a standard blade-cut die is constructed as having a wooden rectangular base block approximately three-quarters of an inch thick into which are secured a plurality of razor blades extending vertically upwards from the upper surface of the wooden block. The razor blades are arranged to form a design such as a letter, number or other such shape with the cutting edge of each razor blade at the upper edge thereof. Surrounding the razor blades and extending slightly (one-sixteenth inch) above the cutting surface of each razor blade is a block of foam rubber which prevents a user of the blade-cut die from accidentally cutting him or herself when handling the blade-cut die. The foam rubber deforms downwards when pressure is applied thereto, thus exposing the cutting surface of the razor blades and cutting the appropriate design from the material placed onto the blade-cut die. Of course, other designs of dies are currently available but the present description applies to the most common type of blade-cut die used in the educational and craft fields.

There are numerous other types of pressing and cutting devices which are found in the prior art. These include such devices as Bartesaghi, U.S. Pat. No. 4,516,4057, Treff, U.S. Pat. No. 3,555,949, and Turner, U.S. Pat. No. 2,446,201. None of these devices, however, disclose a device for quickly and efficiently cutting multiple sheets of material such as paper into shapes and designs as designated by a blade-cut die.

It is vitally important that any material cutting device designed for use in the educational or craft markets be designed in such a way as to prevent, as much as possible, accidental injury arising from use of the device. Many of the die cutting presses currently available on the market include dangerous "pinch-points" which are places on the machine into which a finger or other body part could be drawn and damaged. There is therefore a further need for a paper cutting device which includes heightened safety measures to prevent incidental injuries from the use of the device.

Therefore, an object of the present invention is to provide an improved paper cutting device.

Another object of the present invention is to provide a paper cutting device including a base plate for supporting a blade-cut die thereon, a carriage having a press roller, the carriage moveably mounted on the base plate, a drive device for propelling the carriage along the base plate and a die cover device such as a urethane sheet which covers the paper placed on the blade-cut die so that the press roller and carriage may move over the cover thus pressing the paper onto the blade-cut die and cutting the appropriate design out of the paper.

Another object of the present invention is to provide a paper cutting device which includes numerous safety measures to prevent the digits of a user from being drawn into "pinch-points" which could cause damage to those digits.

Another object of the present invention is to provide a paper cutting device which includes a rack and gear system for precisely guiding the carriage along the base plate thereby insuring consistently excellent results in the cutting of materials by the machine.

Another object of the present invention is to provide a paper cutting method which provides a machine as that described above, placing the material to be cut onto the upper surface of the blade-cut die positioned on the base plate, covering the material to be cut with the die cover, and moving the carriage and press roller over the die cover, thereby pressing the die cover down onto the paper and blade-cut die. The blades of the blade-cut die cut into and through the paper, thereby cutting out the desired design from the material being cut.

Finally, an objection of the present invention is to provide a paper cutting device which is relatively simple to manufacture and is safe, efficient, and durable in use.

SUMMARY OF THE INVENTION

The present invention provides a material cutting device for cutting material using blade-cut dies which includes a base plate having opposite sides and opposite ends, the base plate adapted to support a blade-cut die thereon, and a carriage moveably mounted on the base plate. The carriage further includes a press roller rotatably mounted on the carriage, the press roller having a center longitudinal axis and being positioned above the base plate with the center longitudinal axis thereof generally parallel with the base plate. A track device such as a rack is mounted on the base plate with a track follower device such as a gear mounted on the carriage, the track follower device operative to engage the track device thereby guiding movement of the carriage on the base plate. A drive device such as a manual crank or electric motor is mounted on one of the base plate or the carriage and is operative to move the carriage along the track. Further included is a die cover which is operative to cover a blade-cut die supported on the base plate. The press roller, carriage and drive device cooperate such that the drive device propels the carriage along the track with the press roller engaging the die cover above the blade-cut die thereby forcing the die cover into contact with the blade-cut die supported on the base plate. The paper or other material to be cut is sandwiched between the blade-cut die and die cover and when the die cover is pressed into contact with the blade-cut die, the material sandwiched therebetween is cut into the appropriate shape as determined by the shape of the razor blades of the blade-cut die.

The method of cutting material as set forth in the present invention includes the step of providing a material cutting device substantially as described above, placing the material to be cut on top of the blade-cut die supported on the base plate and then placing the die cover over the material to be cut, thereby sandwiching the material between the die cover and the blade-cut die. The drive device is then engaged which causes the carriage to be propelled along the base plate thus bringing the press roller into contact with the die cover. As the press roller travels over the die cover, the die cover is pressed into contact with the blades of the blade-cut die. Of course, because the material to be cut is sandwiched between the blade-cut die and die cover, the blades of the blade-cut die extend through the material to be cut thereby cutting the material into the desired design shape as determined by the blade-cut die. The cut material may then be removed from the device and the device may be used to cut again.

As thus described, the material cutting device and method of the present invention clearly provides a novel and efficient device and method for cutting materials such as paper, fabric, etc. Because the press roller moves over the blade-cut die, the blade-cut die remains stationary on the base plate, thereby ensuring consistently accurate cutting of material. Furthermore, the rack on the base plate and the gear on the carriage intermesh to insure accurate and steady advancement of the press roller over the blade-cut die, thus preventing unacceptable cutting of material. Also, because the press roller moves over the blade-cut die, it has been found that large paper quantities (in excess of ten sheets) may be quickly and accurately cut by the present invention, a feature not found in any device known in the prior art. It is thus seen that the present invention provides a substantial improvement over those devices found in the prior art.

DESCRIPTION OF THE PREFERRED EMBODIMENT

The material cutting device 10 of the present invention is best shown in FIGS. 1–5 as including a base plate 12 which is mounted on four upright legs 14*a,* 14 *b,* 14*c* and 14*d.* In the preferred embodiment, base plate 12 is constructed of a sturdy metal, preferably brushed aluminum for structural strength and weight reduction, and legs 14*a–d* would preferably be constructed of similar material. Base plate 12 is shown as a generally rectangular plate in FIG. 1, but it is to be understood that the precise shape of base plate 12 is not critical to the present invention so long as the functional aspects of the present invention are maintained. In the embodiment shown in FIG. 1, however, the general dimensions of the base plate 12 would be approximately 20" in length, 13" in width, and a thickness of approximately five-eighths (⅝) inches. Each of the legs 14*a–d* would preferably have a height of approximately six inches, although these dimensions and other dimensions set forth in the following description are generally not critical to functionality of the invention, unless otherwise stated.

Figure 1:
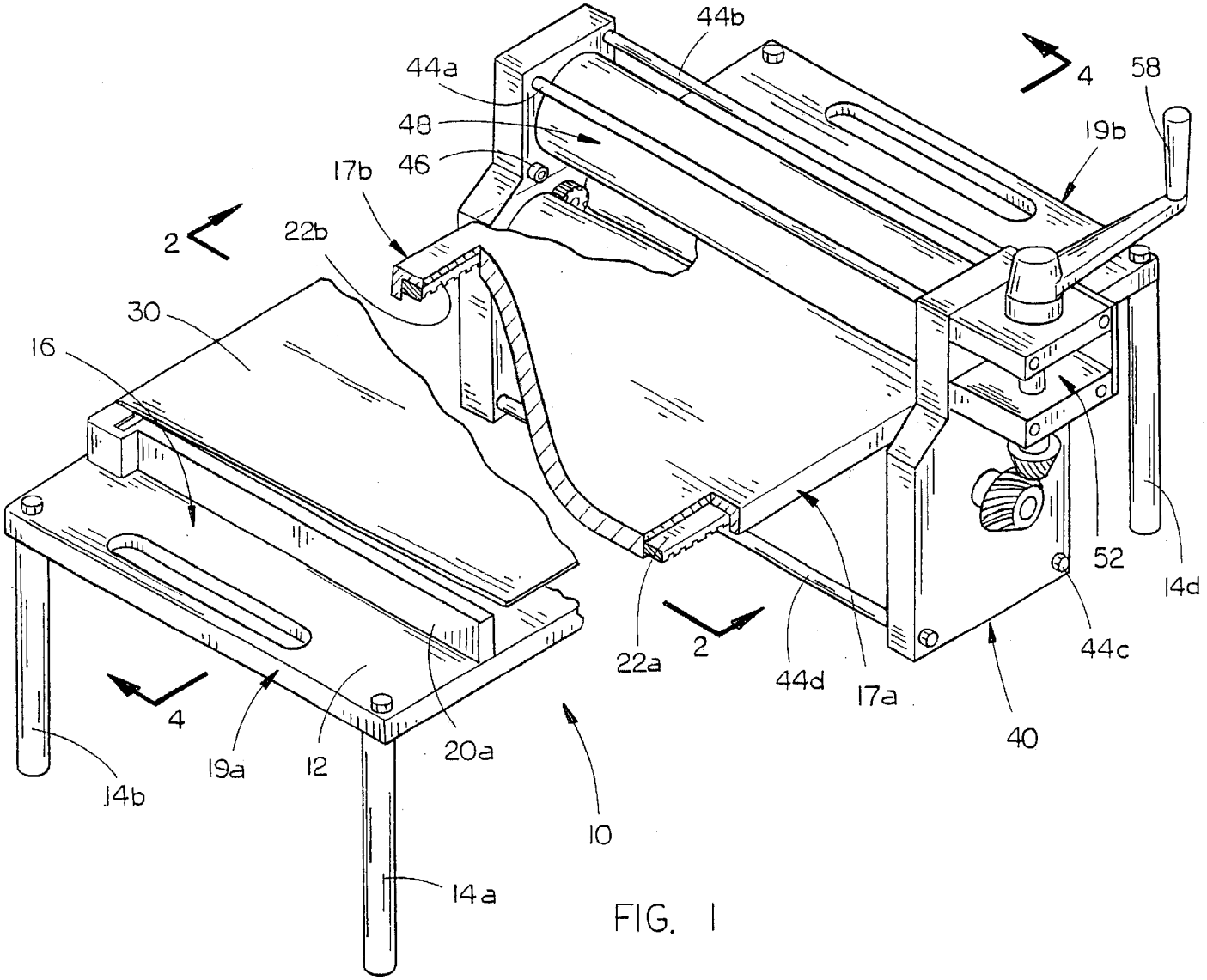
FIG. 1 is a perspective view of the material cutting device of the present invention.
Figure 4:
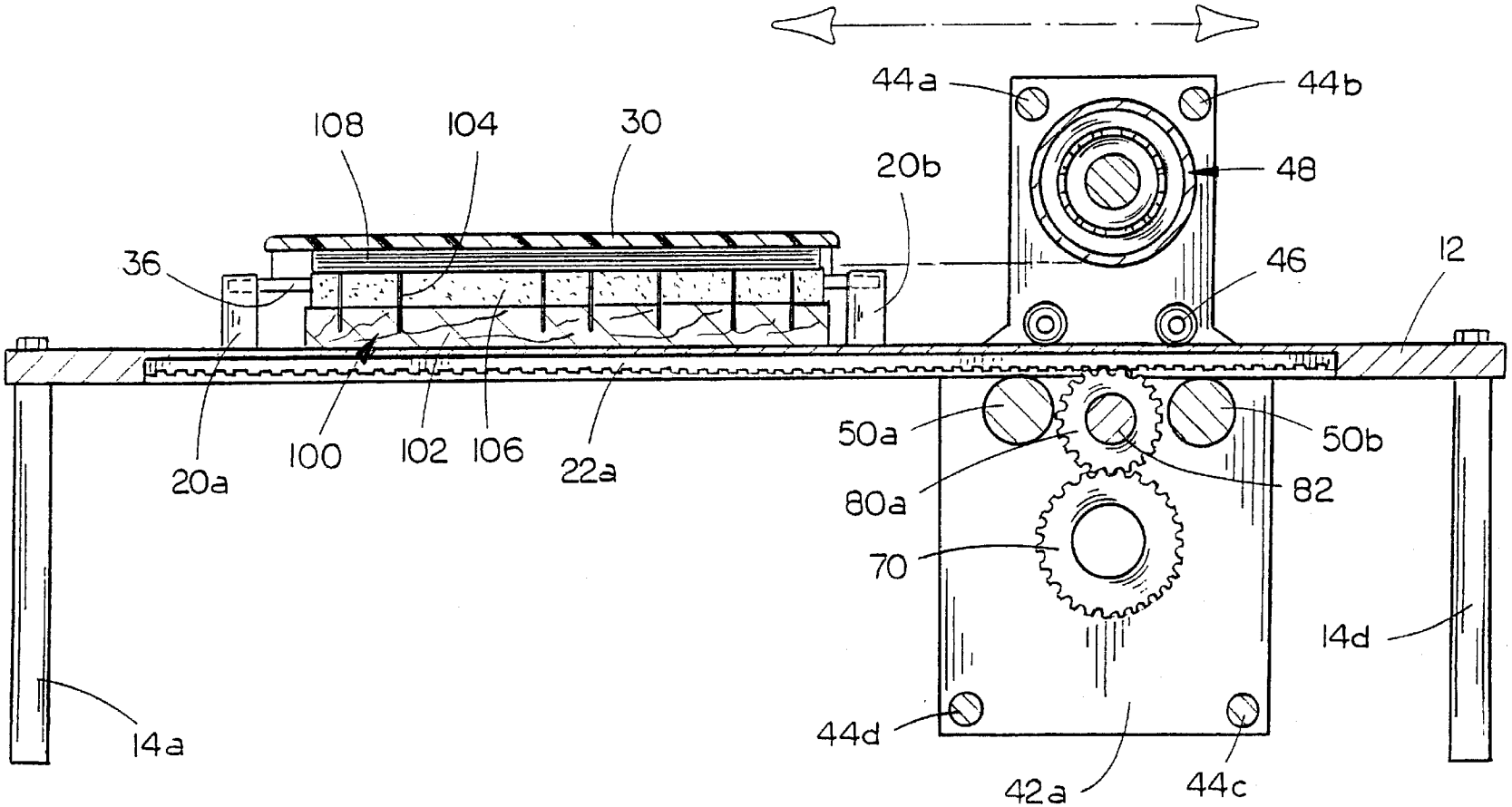
FIG. 4 is a side detail elevational view of the present invention taken along line 4—4 of FIG. 1 showing the relative positioning of the various elements of the invention.

As shown best in FIGS. 1 and 4, mounted on the top surface 16 of base plate 12 are die retention walls 20*a* and 20*b* which are preferably constructed of material similar to that used in the construction of base plate 12 and are approximately one inch in height. Die retention walls 20*a* and 20*b* also preferably extend across the width of base plate 12, although it is not critical that they do so. Die retention walls 20*a* and 20*b* serve two main purposes, the first being to provide a positioning means for a blade-cut die 100 so that the user of the material cutting device 10 is aware of where to position the blade-cut die 100 on the base plate 12. The blade-cut die 100 would thus placed between the die retention walls 20*a* and 20*b*. The second important function of the die retention walls 20*a* and 20*b* is to serve as a releasable pivotal securement point for the die cover 30, the mounting of which will be discussed in more detail later in this description.

Mounted on the underside 18 of base plate 12 are a pair of toothed racks 22*a* and 22*b* which extend generally parallel with one another and generally parallel with the opposite sides 17*a* and 17*b* of base plate 12. In the preferred embodiment, the toothed racks 22*a* and 22*b* would be positioned adjacent the side edges 17*a* and 17*b* of the base plate 12, as shown in FIGS. 1 and 4 and would preferably be constructed of a high tensile strength metal or the like. The toothed racks 22*a* and 22*b* would each have a length of approximately 18 inches and a width of approximately ¼" and would thus extend within one to two inches of the opposite edge 19*a* and 19*b* of base plate 12.

A carriage 40 is movably mounted on base plate 12 as best shown in FIGS. 1–4, the carriage 40 including opposite upright side plates 42*a* and 42*b* which are connected to one another in a fixed spaced-apart position by a plurality of spacer rods 44*a*, 44*b*, 44*c* and 44*d*. It is preferred that the distance between side plates 42*a* and 42*b* be slightly greater than the width of base plate 12 and, therefore, the spacer rods 44*a–d* should be approximately one-quarter inch longer than the width of base plate 12. It is further preferred that side plates 42*a* and 42*b* be constructed of high tensile strength steel or brushed aluminum to provide added durability to the material cutting device 10 of the present invention. Side plates 42*a* and 42*b* would preferably have heights of approximately six (6) inches, widths of approximately three (3) to five (5) inches and thicknesses of approximately one-half to three-quarters of an inch.

Figure 2:
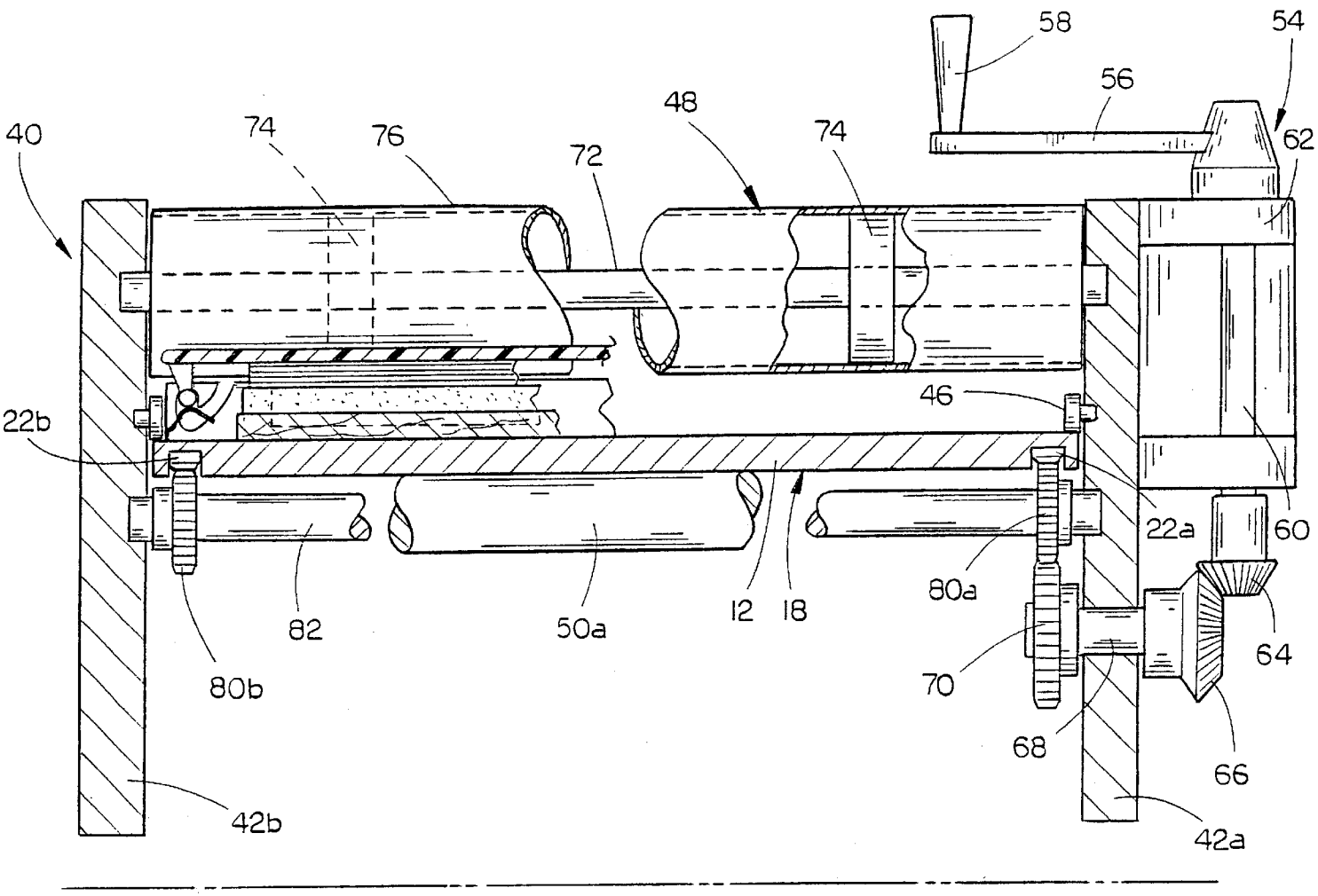
FIG. 2 is an end elevational view of the present invention taken along line 2—2 of FIG. 1 showing the manual drive embodiment of the invention.
Figure 3:
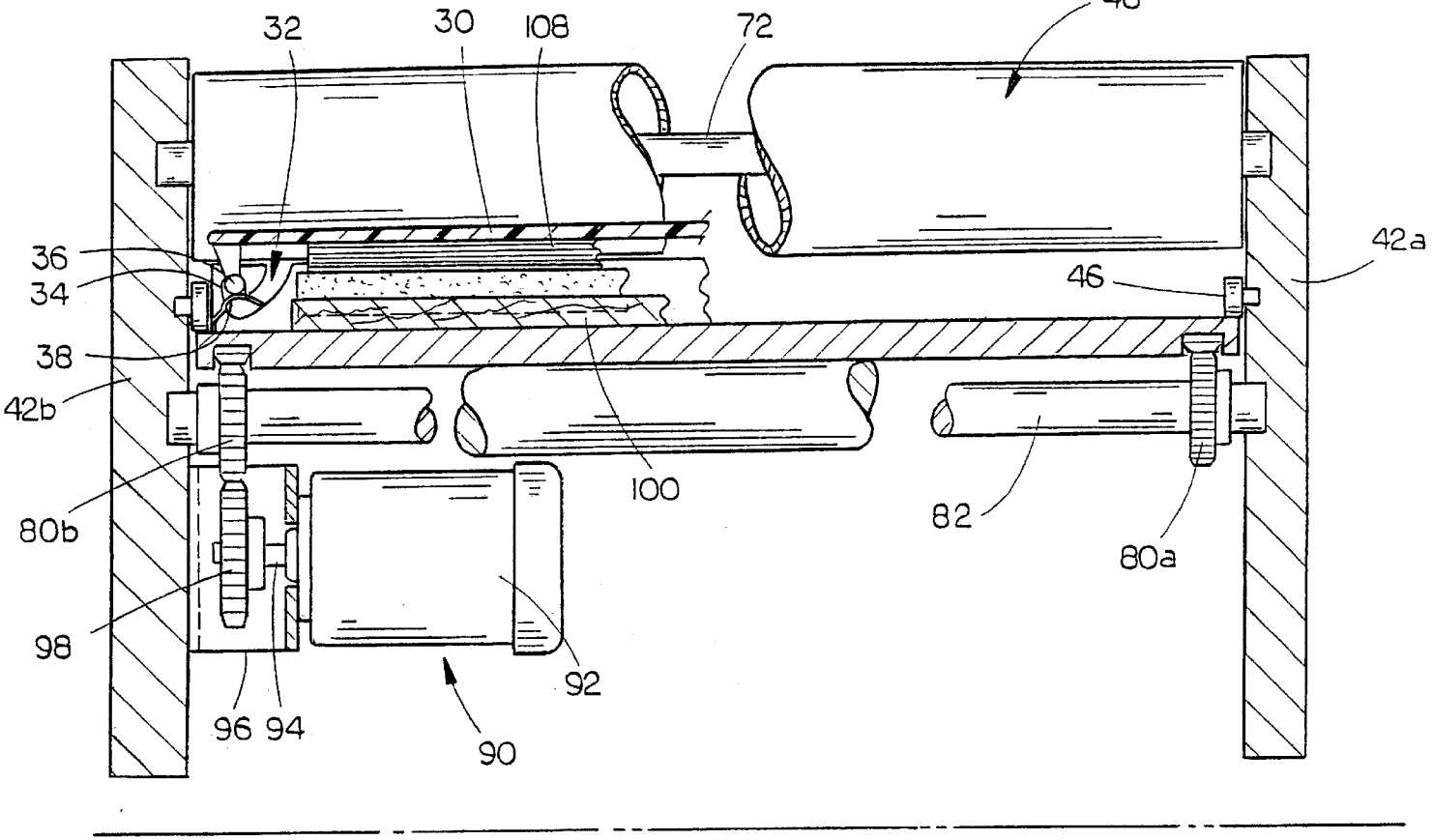
FIG. 3 is an end elevational view of the present invention showing the motor-driven embodiment of the invention.

The side plates 42*a* and 42*b* of carriage 40 are rollerably supported on base plate 12 by one or more rollers 46 mounted on the inside faces of side plates 42*a* and 42*b* and extending inwardly therefrom as best shown in FIGS. 1, 2 and 3. The rollers 46 may be of any suitable design, but it is preferred that the rollers be constructed of durable metal or another such durable substance to increase the usable life span of the rollers 46. The rollers 46 act to support the carriage 40 on the base plate 12 and allow for movement of carriage 40 generally parallel with the side edges 17*a* and 17*b* of base plate 12.

A press roller 48 is rotatably mounted on and extends between side plates 42*a* and 42*b* as shown in FIGS. 1–3 and 5. Press roller 48 is preferably constructed as including an inner shaft 72 having a radius of approximately 0.5" which is rotatably mounted to the side plates 42*a* and 42*b* by ball bearings or the like. Rotatably mounted on inner shaft 72 are two or more roller bearing rings 74, shown best in FIG. 2. The roller bearing rings 74 are mounted such that the inner surfaces of the bearings rollably rest on the outer surface of the inner shaft 72 and the outer surfaces of the bearings rotatably support press tube 76. Press tube 76 is preferably a hollow tube having an inner radius of approximately 1 inch and an outer diameter of approximately 1.25" and is preferably constructed of an extremely rigid and durable material such as hardened steel. The press tube 76 is thus rotatably supported on the inner shaft 72 and is not connected to the side plates 42*a* and 42*b*. Throughout this description, the above-described combination of the inner shaft 72, roller bearings 74 and press tube 76 will be referred to as a unit, the "press roller 48," to simplify the following description. The axis of rotation of the press roller 48 is generally parallel with the plane of base plate 12 and generally perpendicular to the axis of travel of carriage 40.

Rotatably mounted on and extending between side plates 42*a* and 42*b* are a pair of restrictor rollers 50*a* and 50*b*, shown best in FIG. 4, which extend underneath base plate 12 and are designed to prevent upward movement of carriage 40 when press roller 48 engages die cover 30 as will be described later in this description. In the preferred embodiment, restrictor rollers 50*a* and 50*b* are constructed as solid metal rods having radii of approximately 0.5 inches, the restrictor rollers 50*a* and 50*b* being mounted on ball bearings (not shown) which are mounted in side plates 42*a* and 42*b*.

The vertical distance between restrictor rollers 50*a* and 50*b* and rollers 46 is not especially critical to the invention, as rollers 46 are designed solely to permit carriage 40 to travel smoothly over base plate 12 when the press roller 48 is not engaging the die cover 30. However, the vertical distance between restrictor rollers 50*a* and 50*b* and press roller 48 is critical to the invention, as it is this distance that will determine the height of press roller 48 above base plate 12 when press roller 48 engages die cover 30. In the preferred embodiment, the vertical distance between restrictor rollers 50*a* and 50*b* and press roller 48 is measured between the outer diameter of the rollers 50*a* and 50*b* and press tube 76, and can best be seen in FIGS. 4 and 5. This distance is approximately 1.65", although the exact distance is determined by the height of the blade-cut die 100 such that the press roller 48, when passing over the blade-cut die 100, forces the blade-cut die 100 to cut material placed thereon.

Carriage 40 also includes a drive mechanism 52 which, in the embodiment of FIGS. 1 and 2, consists of a manual crank device 54. Manual crank device 54 includes a crank arm 56 having a handle 58 which is mounted on and extends generally perpendicular from a vertically mounted crank shaft 60 which is turn is rotatably supported by a support structure 62 extending outwards from side plate 42*a* of carriage 40. The exact size and shape of the support structure 62 is not critical to the present invention so long as crankshaft 60 is rotatably supported. Mounted on the lower end of crankshaft 60 is a beveled gear 64 which intermeshes with a second beveled gear 66 as shown in FIG. 2. Second beveled gear 66 is mounted on a rotatably mounted shaft 68. Mounted on the inside end of shaft 68 is an upright toothed gear wheel 70 which intermeshes with the drive gear 80*a* as shown in FIGS. 2 and 4. FIG. 2 best shows how the drive gear 80*a* is mounted on draft shaft 82 which extends between and is rotatably mounted on side plates 42*a* and 42*b*. Mounted on the opposite end of draft shaft 82 is a second drive gear 80*b*, drive gears 80*a* and 80*b* operative to engage toothed racks 22*a* and 22*b* as shown best in FIG. 4.

When crank arm 56 is rotated in a counterclockwise direction, crankshaft 60 is likewise rotated thus causing beveled gear 64 to rotate and, therefore, cause rotation of second beveled gear 66. In the preferred embodiment, the relative sizes of the beveled gears 64 and 66 are such that there is both a translation and a reduction of the force applied to the crank arm 56 so that rotation of the crank arm 56 results in substantially increased torque being applied to the toothed gear wheel 70, as very large amounts of force are needed to move the press roller 48 over die cover 30. Rotation of second beveled gear 66 is transmitted by shaft 68 to upright gear wheel 70 which, in rotating, causing drive gear 80*a* to rotate. As drive gear 80*a* is rigidly mounted on drive shaft 82, rotation of drive gear 80*a* results in equal rotation of drive gear 80*b*. As the drive gears 80*a* and 80*b* engage toothed racks 22*a* and 22*b*, rotation of the drive shaft 82 and drive gears 80*a* and 80*b* forces movement of carriage 40 along base plate 12. An important aspect of this design is that the engagement of drive gears 80*a* and 80*b* with toothed racks 22*a* and 22*b* results in precise lateral movement of carriage 40 along base plate 12, thereby rendering consistently excellent results in the cutting of material by the material cutting device 10.

FIG. 3 shows an alternative embodiment of the present invention in which the manual crank device 54 has been replaced by a motorized drive device 90 which, in the preferred embodiment, would include a high torque electric motor 92 such as that manufactured by Oriental Motor. A motor providing 80 in/oz of torque has been found to be sufficient to allow proper operation of the material cutting device 10 but it may be preferable to provide a substantially stronger motor having upwards of 170 in/oz of torque. As is well know in the art of electric motors, power for the electric motor may be provided by battery means or by connection to an electrical outlet and, further, that the electric motor 92 would include an on/off means such as a switch. These features are not shown in the drawings of the present invention as the exact nature of the on/off switch and/or power supply for the electric motor 92 is not critical to the present invention. The drive shaft 94 of the electric motor 92 would extend into a gear box 96 in which a series of reduction gears 98 would act to slow the rotation output of the gear box 96 and increase the torque output. The reduction gears 98 are connected finally to one of the drive gears 80*b* as was previously described in connection with manual crank device 54. It is preferred that electric motor 92 be reversible so that the carriage 40 may be propelled in both directions as shown in FIG. 4. Regardless of which drive mechanism 52 is used with the present invention, however, the drive gears 80*a* and 80*b* and drive shaft 82 combine with toothed racks 22*a* and 22*b* to precisely propel carriage 40 along base plate 12. Of course, other appropriate track and track engaging devices may be substituted for the toothed racks 22*a* and 22*b* and drive gears 80*a* and 80*b* of the present invention so long as the functionality of the invention is not degraded.

The material cutting device 10 of the present invention cuts paper in the following manner. While the following description is directed to the cutting of paper, many different materials may be cut in the same manner, including fabric, sponge, rubber, plastic and wood. A blade-cut die 100 is placed between die retention walls 20*a* and 20*b* on base plate 12 as shown in FIGS. 2–4. The blade-cut die 100 includes a wooden base 102 upwards from which extend a plurality of razor blades 104 which form a desired design. Foam rubber 106 mounted atop wood base 102 of blade-cut die 100 encases razor blades 104 and prevents accidental injury from contact with razor blades 104. Once the blade-cut die 100 is placed between die retention walls 20*a* and 20*b*, one or more sheets of paper 108 are placed on top of the foam rubber 106 of blade-cut die 100 as shown in FIG. 4. The die cover 30 is then pivoted over the paper 108 and blade-cut die 100 so that die cover 30 rests on top of paper 108 thereby sandwiching paper 108 between die cover 30 and blade-cut die 100.

The mounting for die cover 30 is shown best in FIGS. 2 and 3 and shows how die retention walls 20*a* and 20*b* each further include a sloped channel 32 which ends in a receiving pocket 34. A rod 36 is mounted to the underside of die cover 30 and has a length slightly greater than the distance between the inside surfaces of the die retention walls 20*a* and 20*b* such that the ends of rod 36 extend into die retention walls 20*a* and 20*b*. The ends of rod 36 may thus be slid into sloped channel 32 and upwards into retention pocket 34, where the end of rod 36 is releasably secured therein by a leaf spring 38 or the like. The die cover 30 is thus pivotably and removably mounted on base plate 12 as shown in FIGS. 1–4.

Figure 5:
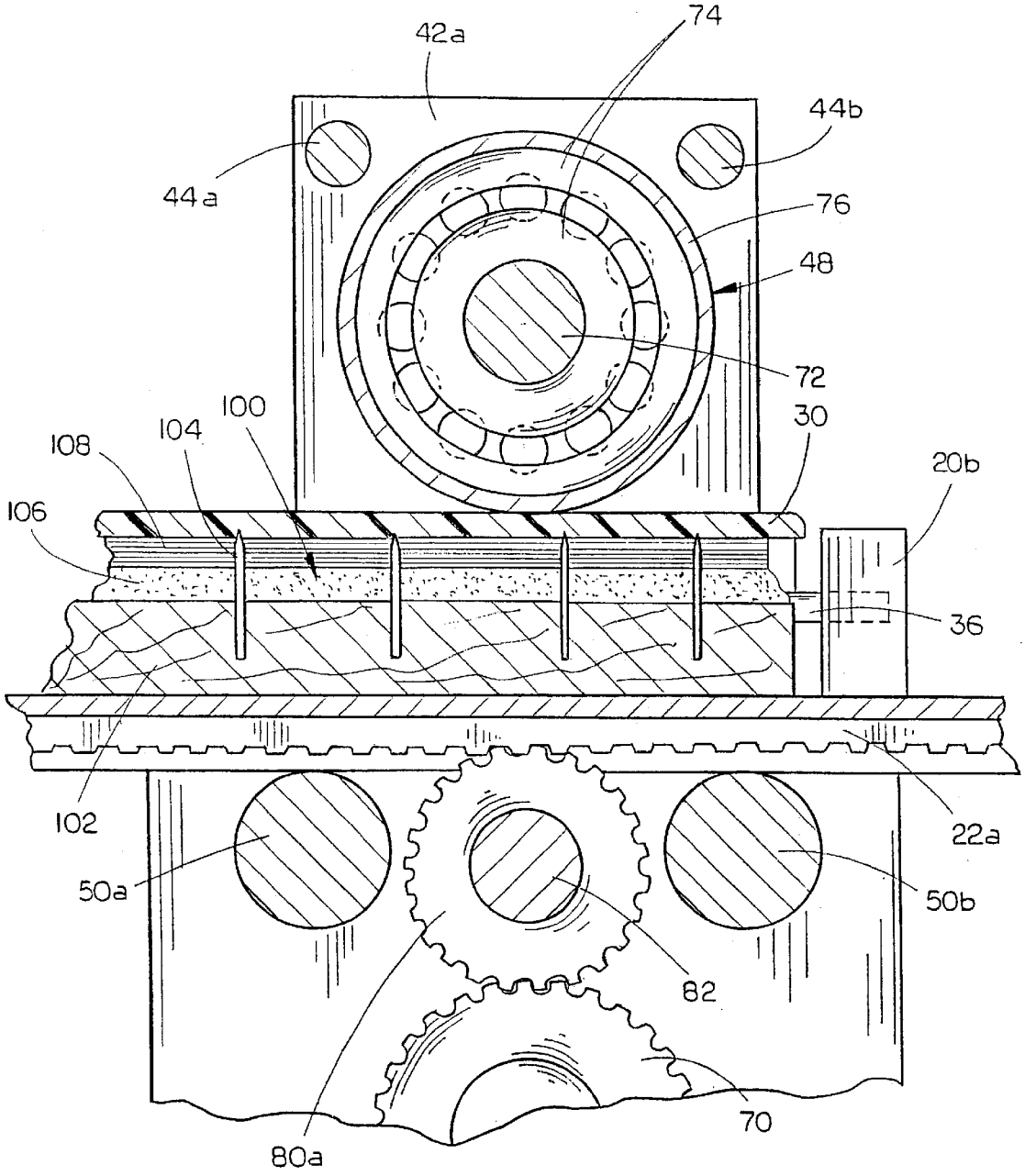
FIG. 5 is a partial detail side elevational view of the present invention showing the press roller engaging the die cover thereby pressing the die cover down onto the blade-cut die and cutting paper sandwiched between the die cover and blade-cut die.

Once the blade-cut die 100, paper 108 and die cover 30 are in place, the carriage 40 begins to move along base plate 12 by engagement of the drive mechanism 52. Upon reaching the die cover 30, the press roller 48 engages the die cover 30 and begins to roll over the die cover 30. The restrictor rollers 50*a* and 50*b* on the underside of base plate 12 prevent upward movement of the carriage 40 and thus the press roller 48 remains in a precise vertical position where the die cover 30 is engaged to press down on to the paper 108. FIG. 5 shows the paper cutting process in action where the press roller 48 is engaging the die cover 30 pressing the die cover 30 downwards. In turn, the paper 108 is forced downwards compressing the foam rubber 106 and exposing the razor blades 104 which proceed to cut through the paper 108. To insure proper cutting of the paper 108 it is preferred that die cover 30 be pressed downwards sufficiently such that the razor blades 104 extends slightly into die cover 30 as shown in FIG. 5. For this reason, die cover 30 is preferably constructed of a urethane rubber compound which has memory, meaning that the indentations and/or cuts which are formed in the die cover 30 as a result of the razor blades 104 being inserted thereinto will eventually reseal to a great extent thus increasing the useable life span of the die cover 30. Also, it is preferred that die cover 30 have approximate dimensions of 13" by 12", although it is to be understood that the die cover 30 of the present invention may be smaller or larger depending on the blade-cut die 100 to be covered. In fact, it is not necessary for the die cover 30 to be mounted on the paper cutting machine 10 at all, as the die cover 30 could be used as a separate plate of material which is simple placed over the paper 108 and blade-cut die 108.

Figure 6:
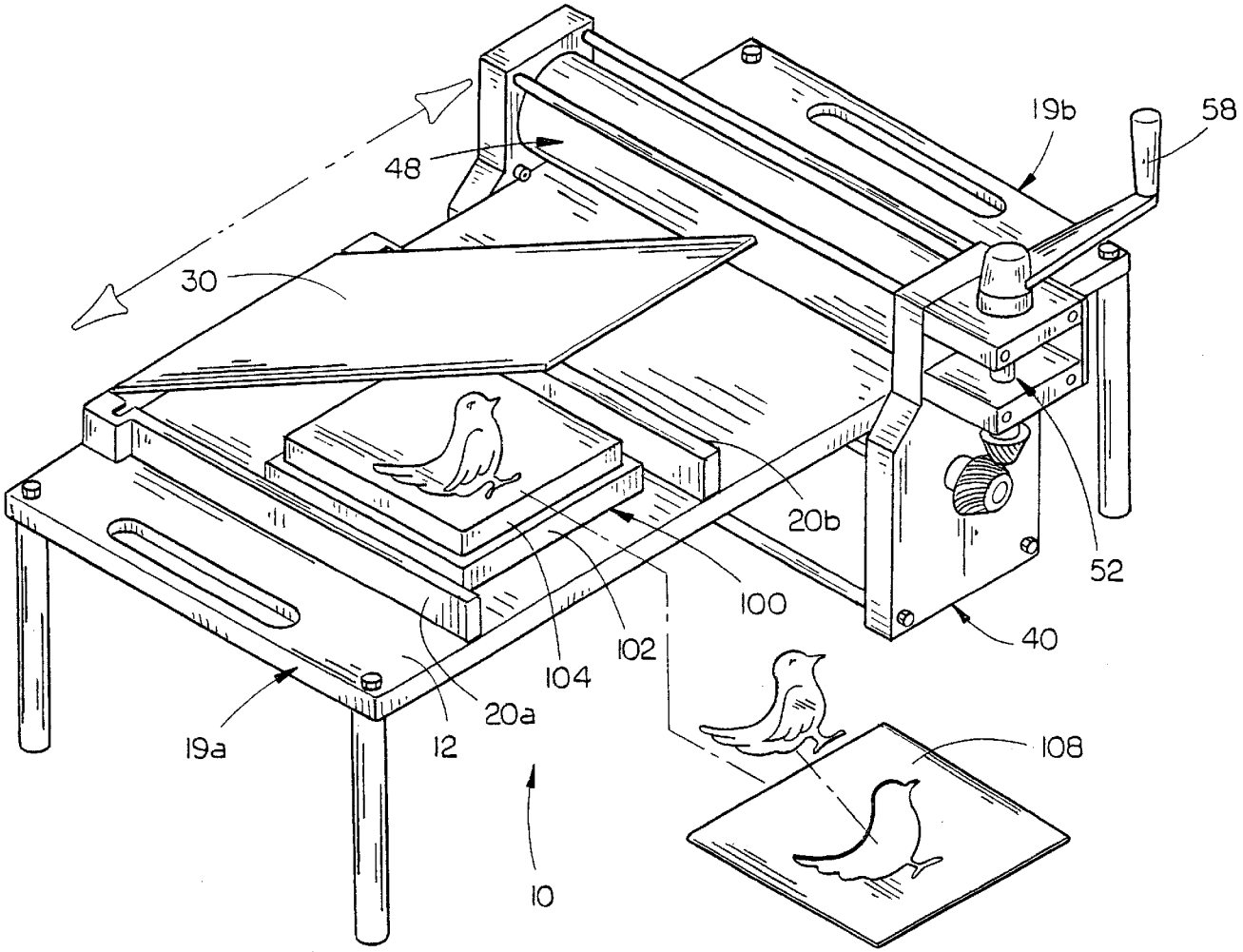
FIG. 6 is a perspective view of the material cutting device of the present invention showing the paper after it has been cut.

As the press roller 48 continues to move across the die cover 30, the paper 108 is cut by the razor blades 104 in the design in which the blades are arranged. Also, as the rod 36 is held within the retention pocket 34 by leaf spring 38, the die cover 30 may move downwards due to the press roller 48 contacting it, thus preventing interference of the rod with the cutting process and ensuring accuracy in the cutting of the paper 108. Once the press roller 48 is moved entirely across the die cover 30 by movement of carriage 40, the drive mechanism 52 is reversed and the carriage 40 returns to its initial position as shown in FIG. 4. The die cover 30 is then opened and the paper 108 may be removed. The paper 108 has now been cut into the desired shapes as determined by the razor blades 104 on the blade-cut die 100, as shown in FIG. 6.

While the above description pertains to the cutting of material, it has been found that the present invention may also be used to emboss material. Material which has been embossed includes raised or depressed designs formed in the material, thus adding three-dimensional depth to the previously two-dimensional material. The embossing process of the present invention would substitute a design to be embossed for the blade-cut die 100 previously discussed. The design to be embossed would be raised above the surrounding mold approximately ⅛" to ¼" and as the press roller 48 travels over the design, the paper or other such material placed over the design is pressed down onto the raised design. The imprint of the design is transferred to the material and the material is thus embossed.

The present invention has been described as being designed for use in the craft and educational markets, but it is to be understood that by modifying the dimensions of the present invention and making other small modifications, the present invention would also have numerous industrial uses. For example, such uses might include the cutting out of gaskets from rubber, the cutting of shaped sponges for certain industrial uses, and the cutting of plastics into desired shapes for various commercial uses. The method of cutting such materials would be substantially the same as was previously described in connection with the cutting of paper, but some modifications may be necessary and/or desirable to streamline the process. The general material cutting device design would remain similar, however.

One other feature of the present invention should be presented, namely that the material cutting apparatus 10 as shown in the Figures would preferably further include a set of protective covers (not shown) which would act to prevent users of the apparatus from having their extremities "pinched" by contact with the moving elements of the machine. These covers will be of various design, but will enclose at a minimum the carriage 40 and drive mechanism 52.

It is to be understood that numerous modifications, additions and substitutions may be made to the material cutting device 10 of the present invention which fall within the intended broad scope of the appended claims. For example, the construction materials and dimension set forth in the preceding description may be modified or changed so long as the functionality of the invention is not affected. Furthermore, so long as the precise height of the press roller 48 above base plate 12 is maintained the specific mechanism for moving the press roller 48 across die cover 30 is not critical and may, of course, be different from that disclosed above. Also, several blade-cut dies may be used underneath the die cover 30 of the present invention at the same time and the cutting process would remain substantially the same. There has thus been shown and described a material cutting device which accomplishes at least all of the stated objectives.

What is claimed is:

1. A material cutting device for cutting material using blade-cut dies, said device comprising:

a base plate having opposite sides and opposite ends, said base plate adapted to support a blade-cut die thereon;

a carriage movably mounted on said base plate;

a rigid press roller rotatably mounted on said carriage, said press roller having a center longitudinal axis and being positioned above said base plate, said axis being generally parallel with said base plate, said press roller being fixedly mounted on said carriage save for rotation thereof such that vertical and horizontal movement of said press roller relative to said carriage is completely restricted and such that vertical movement of said press roller relative to said base plate is completely restricted;

track means mounted on said base plate;

a track follower mounted on said carriage operative to engage said track means thereby guiding movement of said carriage on said base plate;

drive means mounted on one of said base plate and said carriage operative to move said carriage along said track means;

die cover means having a deformable, resilient surface being operative to cover a blade-cut die supported on said base plate;

said deformable, resilient surface of said die cover means having memory so that the cuts which are formed in said die cover means as a result of razor blades of a blade cut die being inserted thereinto will substantially reseal;

said drive means propelling said carriage along said track means, said press roller engaging said die cover means above a blade-cut die thereby forcing said resilient surface of said die cover means into contact with a blade-cut die supported on said base plate whereby material to be cut positioned between said die cover means and said blade-cut die is cut in a shape designated by the blade-cut die.

2. The material cutting device of claim 1 wherein said carriage further comprises two generally upright side plates on opposite sides of said base plate, said side plates connected to one another in a fixed, spaced-apart relation, said side plates movably mounted on said base plate, said press roller extending between and rotatably mounted on said side plates above said base plate, the axis of rotation of said press roller being generally parallel with said base plate and generally perpendicular to the axis of travel of said carriage on said base plate.

3. The material cutting device of claim 2 wherein said carriage further comprises at least one restrictor roller extending between and rotatably mounted on said side plates below said base plate, said restrictor roller operative to restrict upward movement of said carriage upon said press roller engaging said die cover.

4. The material cutting device of claim 2 wherein said press roller comprises an inner shaft having an outer surface and being rotatably mounted on said side plates and extending therebetween, at least two roller bearing rings each having inner and outer surfaces, said bearing rings mounted on said inner shaft such that the inner surfaces of said bearing rings rollably rest on the outer surface of said inner shaft and the outer surfaces of said bearing rings rotatably support a press tube, said press tube being a hollow tube rotatably supported on said inner shaft which is not connected to said side plates.

5. The material cutting device of claim 1 wherein said track means comprises at least one toothed rack extending generally parallel with said opposite sides of said base plate, said toothed rack mounted on the underside of said base plate.

6. The material cutting device of claim 5 wherein said track follower comprises at least one drive gear rotatably mounted on said carriage, said at least one drive gear operative to engage said at least one toothed rack such that engagement of said at least one drive gear with said at least one toothed rack results in precise movement of said carriage along said base plate.

7. The material cutting device of claim 6 wherein said drive means comprises a manual crank device including a crank arm mounted on a crank shaft having a lower end which is rotatably supported by a support structure mounted on said carriage, said crank shaft further including a beveled gear mounted on the lower end thereof, said beveled gear intermeshing with a second beveled gear mounted on a shaft rotatably mounted on said carriage, an upright toothed gear wheel mounted on said shaft which intermeshes with said at least one drive gear operative to engage said at least one toothed rack where engagement of said manual crank device rotates said at least one drive gear thereby propelling said carriage along said base plate.

8. The material cutting device of claim 6 wherein said drive means comprises a motorized drive device including a high torque electric motor powered by an electrical power supply device, said electric motor having a drive shaft extending into a gear box having a series of reduction gears operative to slow the rotation output of said drive shaft and increase the torque output, one of said reduction gears being operatively connected to said at least one drive gear operative to engage said at least one toothed rack whereby engagement of said motorized drive device rotates said at least one drive gear thereby propelling said carriage along said base plate.

9. A material cutting device for cutting or embossing material using design forming devices such as blade-cut dies, molds, cut out designs or the like, said device comprising:

a base plate having an underside, opposite sides and opposite ends, said base plate adapted to support a design forming device thereon;

a carriage movably mounted on said base plate;

a rigid press roller rotatably mounted on said carriage, said press roller having a center longitudinal axis and being positioned above said base plate, said axis being generally parallel with said base plate, said press roller being fixedly mounted on said carriage save for rotation thereof such that vertical and horizontal movement of said press roller relative to said carriage is completely restricted and such that vertical movement of said press roller relative to said base plate is completely restricted;

at least one toothed rack extending generally parallel with said opposite sides of said base plate, said toothed rack mounted on the underside of said base plate;

at least one drive gear rotatably mounted on said carriage, said at least one drive gear operative to engage said at least one toothed rack such that engagement of said at least one drive gear with said at least one toothed rack results in precise movement of said carriage along said base plate;

a motorized drive device including a high torque electric motor powered by an electrical power supply device, said electric motor having a drive shaft operatively connected to at least one drive gear operative to engage said at least one toothed rack whereby engagement of said motorized drive device rotates said at least one drive gear thereby propelling said carriage along said base plate;

die cover means having a deformable, resilient surface being operative to cover a said deformable, resilient surface of said die cover means having memory so that the cuts which are formed in said die cover means as a result of razor blades of a blade cut die being inserted thereinto will substantially reseal; design forming device supported on said base plate;

said motorized drive device propelling said carriage along said base plate, said press roller engaging said die cover means above a design forming device thereby forcing said resilient surface of said die cover means into contact with a design forming device supported on said base plate whereby material to be modified positioned between said die cover means and said design forming device is modified in a shape designated by the design forming device.

* * * * *